United States Patent [19]

Schmitz et al.

[11] 4,227,852

[45] Oct. 14, 1980

[54] RELEASABLE BACKHOE BOOM LOCK

[75] Inventors: Floyd A. Schmitz; William F. Joy, both of Burlington, Iowa

[73] Assignee: J. I. Case Company, Racine, Wis.

[21] Appl. No.: 5,769

[22] Filed: Jan. 23, 1979

[51] Int. Cl.[3] ..... E02F 3/32

[52] U.S. Cl. ..... 414/694; 414/722

[58] Field of Search ..... 414/686, 690–695, 414/717, 697, 718, 722, 702; 172/311, 456, 481, 59, 674; 212/145; 298/23 M, 23 A, 23 B

[56] References Cited

U.S. PATENT DOCUMENTS

| | | | |
|---|---|---|---|
| 1,250,838 | 12/1917 | Frank | 298/23 A |
| 3,376,984 | 4/1968 | Long et al. | 414/694 |
| 3,811,582 | 5/1974 | Shumaker et al. | 414/694 |
| 3,874,459 | 4/1975 | Herberholm | 172/311 |
| 3,921,835 | 11/1975 | Baker et al. | 414/694 |
| 3,951,281 | 4/1976 | Parquet | 212/145 X |
| 3,955,695 | 5/1976 | Maurer | 414/697 |

*Primary Examiner*—Stephen G. Kunin
*Assistant Examiner*—Terrance L. Siemens
*Attorney, Agent, or Firm*—Dressler, Goldsmith, Shore, Sutker & Milnamow, Ltd.

[57] ABSTRACT

A releasable boom lock located between a swing tower that pivotally supports a boom consists of a latch pivoted on the swing tower and a pin located on the boom. The pin and latch are designed to automatically interlock the boom and swing tower when the boom is moved to a transport position and are separable from each other by manipulation of a tool fluid ram pivotally supported on the boom. The tool fluid ram has an extension held in a fixed position so that operation of the fluid ram, which causes it to pivot on the boom, will move the extension into engagement with the pivotable latch and release the boom from the swing tower. The extension can be released to be pivotable on the ram to allow operation of the ram without releasing the latch.

4 Claims, 4 Drawing Figures

10
12
14
16
18
20
22
24
26
34
36
38
40
42
44
47
48
49
50
52

3
3
16
20
22
24
28
30
32
44
46
47
60
62
64
66
68
70
72
74
90
92
94
96
102
108

RELEASABLE BACKHOE BOOM LOCK

DESCRIPTION

Technical Field

The present invention relates generally to earthworking implements, such as backhoes, and more particularly to a latching mechanism for locking the boom in a transport position for movement from one job site to another. While not limited to any specific type of earthworking implement, the backhoe to which this present invention pertains is of the type disclosed in Long et al. U.S. Pat. No. 3,376,984.

BACKGROUND OF PRIOR ART

Various types of latching mechanisms have been proposed for latching a boom onto a frame upon which the boom is pivoted. Examples of such devices are disclosed in U.S. Pat. No. 3,811,582 and No. 3,921,835.

Both types of devices disclosed in the respective patents have been operated successfully for producing the desired result. However, both of the types of latch mechanisms disclosed in these patents require several components that to some degree restrict the operability of the unit and the visibility by the operator during earthworking operations.

SUMMARY OF THE INVENTION

According to the present invention, a releasable lock mechanism is designed such that a boom can be locked to the frame upon which it is supported and can be released by manipulation of the controls that are located in the operator's compartment for the vehicle thereby eliminating the need for the operator to dismount and lock the boom in a transport position on the vehicle.

More specifically, the implement to which this invention pertains includes a boom pivoted on a swing tower that forms part of the vehicle with the boom being pivoted between transport and working positions about the swing tower pivot and a dipper assembly including at least one member that has an intermediate portion pivoted on the boom at a location spaced from the swing tower pivot and being moved between extreme positions by a fluid ram that has a first element pivoted on the boom and a second element pivoted on one end of the intermediate member.

The releasable lock means between the boom and the swing tower includes a latch that is pivoted on the swing tower and has a recess which receives a pin that is carried by the boom. The latch is normally held in a first position and is movable to a second position by a camming action between the latch and the pin so that the pin is automatically received into the recess when the boom reaches a transport position.

To release the releasable lock means, the tool or dipper assembly fluid ram is retracted from its fully extended position, which defines the transport position for the dipper assembly on the boom, towards a maximum extended position with respect to the boom. The fluid ram has an extension which engages a free end of the latch and pivots the latch to a released position.

The extension is preferably pivotally supported on the end of the fluid ram and is retained in a fixed position by a retaining means which can be removed so that the dipper assembly can be manipulated while the boom remains latched to the swing tower.

DETAILED DESCRIPTION

Figure 1:
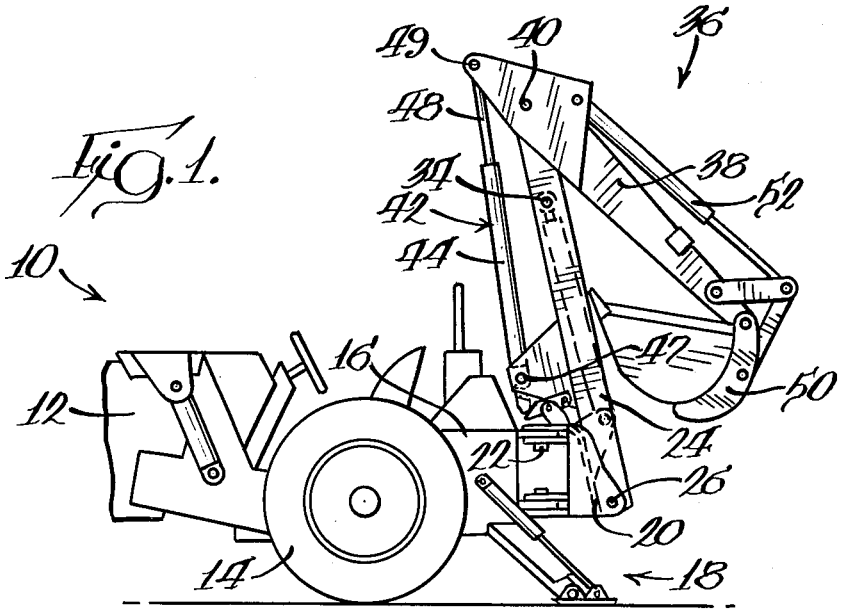
FIG. 1 shows a fragmentary side elevation view of a vehicle having the present invention incorporated therein.

While this invention is susceptible of embodiment in many different forms, there is shown in the drawings and will herein be described in detail a preferred embodiment of the invention with the understanding that the present disclosure is to be considered as an exemplification of tne principles of the invention and is not intended to limit the invention to the embodiment illustrated.

FIG. 1 of the drawings shows the rear end portion of a vehicle, generally designated by reference numeral 10, including a frame 12 supported by a pair of rear wheels 14 (only one being shown). An implement frame 16 is supported on the rear end of frame 12 and has outrigger assemblies 18 on opposite sides thereof (one being shown). A swing tower 20 is pivotally supported on frame 16 by a pair of pivot pins 22 which define a generally vertical pivot axis between frame 16 and swing tower 20.

Figure 3:
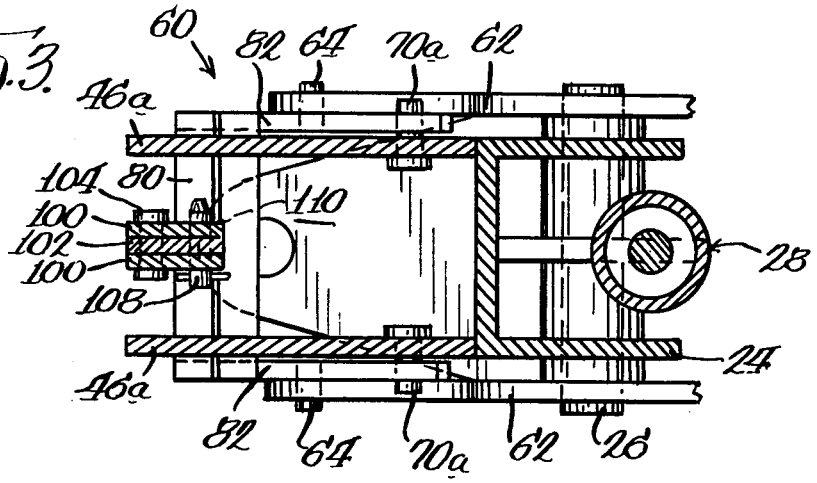
FIG. 3 is a sectional view as viewed along line 3—3 of FIG. 2.

An elongated boom 24 is pivotally supported on swing tower 20 through a generally horizontal pivot pin 26. In the illustrated embodiment, the boom is illustrated as being generally U-shaped in cross section (FIG. 3). However, the boom could also be a twin boom of the type generally disclosed in Long U.S. Pat. No. 4,074,821, wherein a pair of transversely spaced boom elements define the boom with a space between which receives a boom fluid ram 28. Boom fluid ram 28 has one end pivoted by a pin 30 on an integral extension 32 which forms part of swing tower 20 while the opposite end thereof is pivoted on boom 24 through a pivot pin 34 (FIG. 1).

A dipper assembly generally, designated by reference numeral 36, is pivotally supported on the outer end of boom 24 and includes an elongated member 38 that has an intermediate portion pivoted through pivot pin 40 on the free end of boom 24 through a dipper assembly or tool fluid ram 42. Tool fluid ram 42 includes a first element or cylinder 44, pivoted on an integral extension 46 of boom 24 by a pivot pin 47 while a second element or piston rod 48 is pivotally connected to a free end of member 38 through a pin 49. The opposite end of elongated member 38 has a bucket 50 pivotally supported thereon and movable between positions through a bucket fluid ram 52.

With the structure so far described, boom 24 is pivoted on swing tower 20 through fluid ram 28 during normal working operations and is also capable of being moved to an overcenter transport position as is more fully described in Long et al. U.S. Pat. No. 3,376,984, which is incorporated herein by reference. In the transport position, boom 24 has its longitudinal axis located forward of the longitudinal axis for fluid ram 28, as illustrated in FIG. 1.

Dipper assembly 36 is likewise movable between extreme positions, one of which may be considered the transport position and a second position which may be considered the maximum extended position. These two positions are achieved by extending and retracting fluid ram 42. In the transport position, illustrated in FIG. 1, the dipper assembly 36 is in a transport position wherein the bucket is positioned as close as possible to the elongated boom 24 and fluid ram 42 is in its fully extended position. Fluid ram 42 is retracted to move dipper assembly 36 from its transport position towards a maximum extended position with respect to boom 24. During such movement, the entire fluid ram is pivoted generally counterclockwise about lower pivot pin 47 and this counterclockwise pivotal movement is utilized as part of the release means for the releasable boom lock that will not be described.

Figure 2:
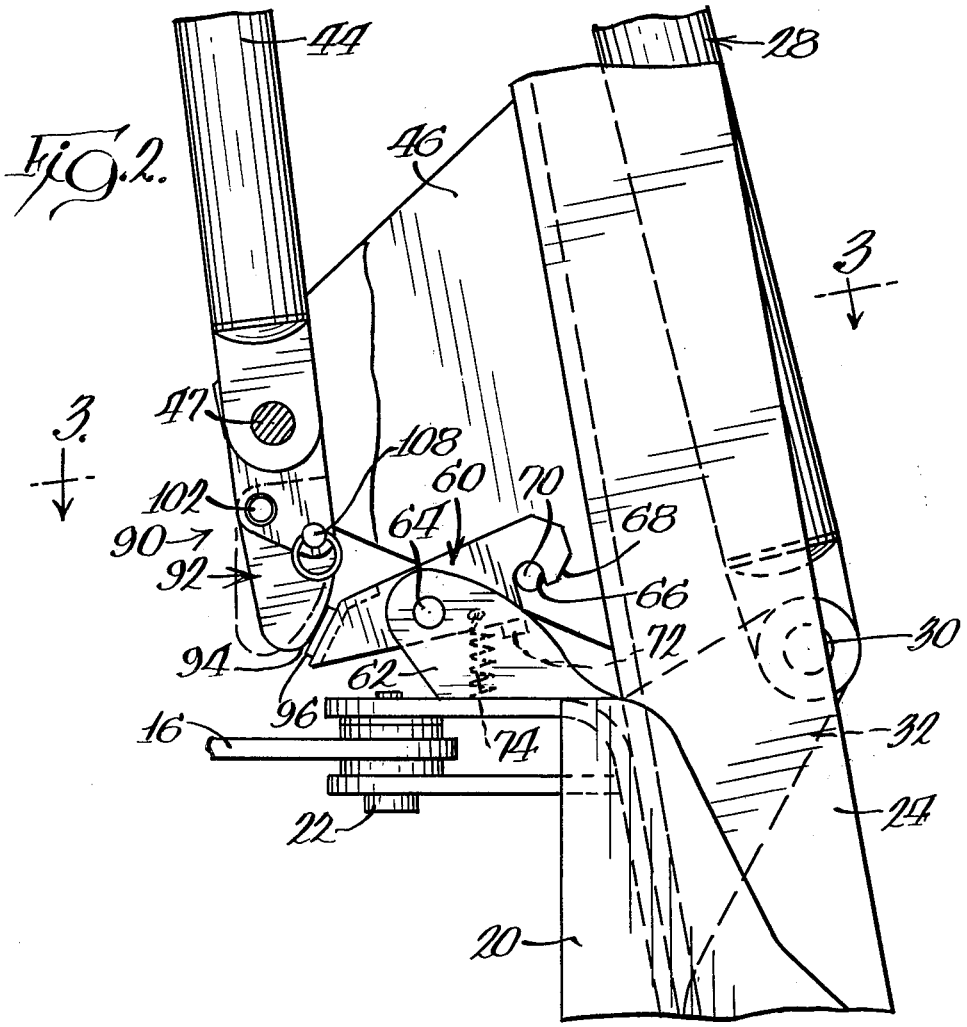
FIG. 2 is an enlarged fragmentary side elevation view of the various components of the implement with the boom being locked in a transport position on a swing tower.

According to the present invention, a releasable lock means is interposed between swing tower 20 and boom 24 which is automatically locked when the boom and dipper assembly are in a predetermined position and the boom is moved to the transport position while being capable of being released merely by manipulation of the tool fluid ram. The details of the releasable latch mechanism or lock means is illustrated in FIGS. 2 and 3 and consists of a latch 60 pivoted on a pair of lugs 62 that are secured to the upper surface of swing tower 20. This pivotal connection is defined by a pin 64 (FIG. 2). Pivoted latch 60 has a recess means 66 adjacent one end thereof with a camming surface 68 on the free end of the latch mechanism terminating at recess 66. Boom 24, specifically integral extension 46 has a pin 70 secured thereto which is adapted to be received into recess 66 as will be described later.

Each lug 62 also has a stop element 72 located in the pivotal path of movement of latch 60 and latch 60 is normally biased to a first position illustrated in FIG. 2 biasing means 74.

The further details of latch 60 are specifically illustrated in FIG. 3 wherein latch 60 is defined by a base portion 80 having a pair of integral arms 82 at opposite ends thereof with each arm having an intermediate portion pivotally supported by a pin 64 on lugs 62. Also, lugs 62 are positioned on swing tower 20 such that arms 82 are located between lugs 62 and opposed surfaces of plates **46*a* that define integral extension 46 which is part of boom 24. Thus, arms 82 extend along opposed surfaces of boom 24. Pin means 70 is defined by a pair of pins 70*a* which extend from opposed surfaces of plates 46*a* of boom 24 and are located in the pivotal path of movement of arms 82**, as will be explained later.

Figure 4:
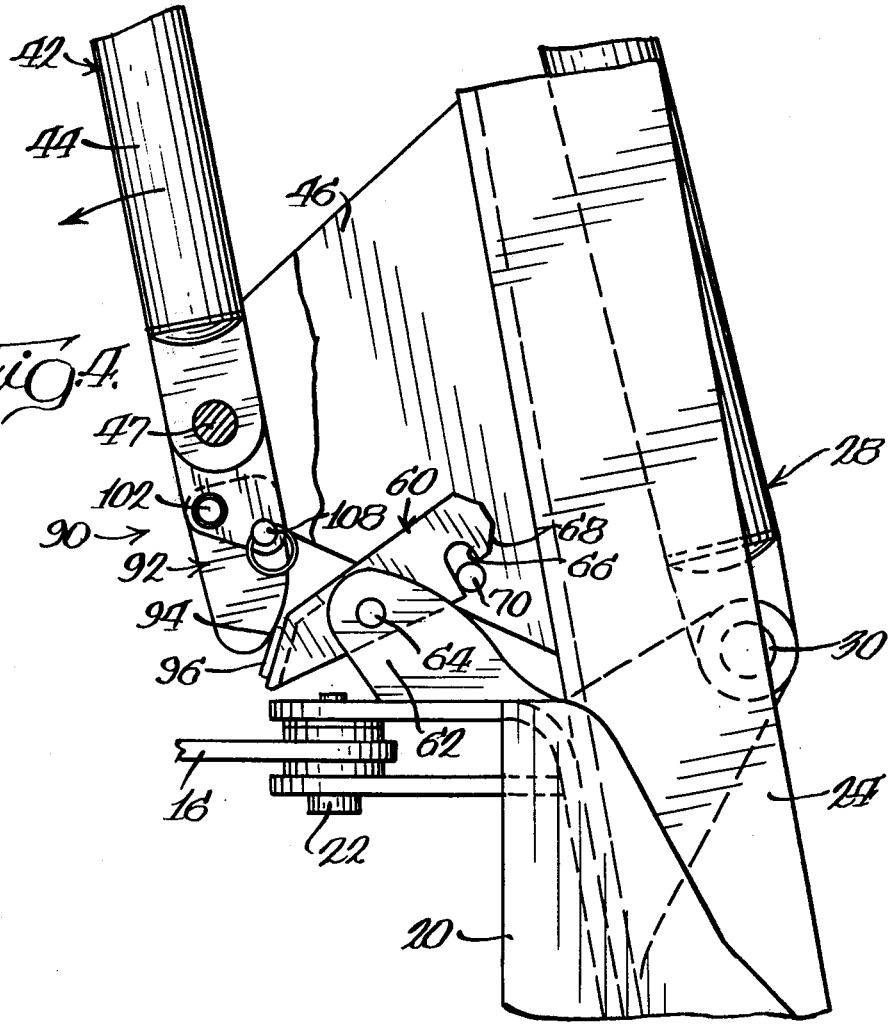
FIG. 4 is a view similar to FIG. 2 showing the manner in which the boom latch is released by manipulation of the tool fluid ram.

According to one aspect of the present invention, fluid ram 42, particularly cylinder 44, incorporates unlatching means 90 for automatically releasing latch 60 from pin means 70 by pivotal movement of fluid ram 42. As illustrated in FIGS. 2 and 4, the unlatching means 90 consists of an extension 92 that extends from cylinder 44 and has a free end portion 94 located in the pivotal path of movement of latch 60. Latch 60 has a plate or abutment means or camming surface 96 secured to base portion 80. Thus, as fluid ram 42 is moved from its fully extended position illustrated in FIG. 1 towards a retracted position (not shown) fluid ram 42 will pivot counterclockwise from the position illustrated in FIG. 2 towards the position illustrated in FIG. 4, wherein the sliding movement of the free end portion 94 and camming surface 96 will pivot latch 60 from the latched position illustrated in FIG. 2 towards the unlatched position illustrated in FIG. 4. After fluid ram 42 has been fully retracted, fluid ram 28 can then be manipulated so that boom 20 can be moved from the overcenter transport position to a working position as is customary in the art. By properly configuring the various components, particularly latch 60 and extension 92, very few components are needed for allowing the operator to automatically unlatch the boom by manipulation of the controls in the operator's station.

In some instances it may be desirable to be capable of manipulating the dipper assembly while the boom remains locked to the swing tower such as when the dipper assembly is utilized for craning functions. For this purpose, extension 92 is in the form of a pair of integral elements 100 that extend from cylinder 44 and define a space therebetween. A single member 102 is located between spaced extensions 100 and is pivotally supported thereon by a pin 104. The extension further includes retaining means for releasably retaining member 102 in a fixed position with respect to cylinder 44. This retaining means is illustrated as including a latch pin 108 that is received into aligned openings 110 that are located in members 100 and 102. Thus, pin 108 can be removed by the operator so that pivotal movement of fluid ram 42 about pivot pin 47 will not release latch 60 since member 104 is freely pivotable from the position illustrated in solid lines in FIG. 2 to the position illustrated in dotted lines in FIG. 2.

The releasing means of the present invention is an extremely simplified version of what has heretofore been proposed for an automatic release mechanism for unlatching a boom from its support.

Of course, it will be appreciated that while a specific embodiment has been illustrated, numerous modifications come to mind without departing from the spirit of the invention. For example, latch 60 could be in the form of a single arm member pivoted along a plane coincident with the center of cylinder 44 and located between integral extensions 46 so that a single pin could be utilized as part of the latch means.

The boom could also take various other configurations and the latching and unlatching mechanism could still function generally in the same manner described above.

What is claimed is:

1. In an earthworking implement having one end of a boom pivoted on a swing tower between transport and working positions and a dipper assembly including a member having an intermediate portion pivoted on said boom at a location spaced from the swing tower and boom pivot, said dipper assembly being pivoted on said boom by a fluid ram having a first element pivoted on said boom and a second element pivoted on one end of said intermediate member and movable between fully extended and retracted positions respectively defining a transport position and a maximum extended position of an opposite end of said dipper assembly with respect to said boom, and releasable lock means between said boom and said swing tower, said releasable lock means including a latch pivoted on said swing tower between first and second positions, said latch having a recess adjacent one end thereof, pin means carried by said boom and adapted to be received in said recess and positioned so that movement of said boom to said transport position will produce engagement between said latch and said pin means to cause said latch to be pivoted from said first position to said second position until said recess is aligned with said pin means and have said pin means received into said recess, and unlatching means for pivoting said latch between said positions to release said latch, said unlatching means including an extension on said first element, said extension being aligned with said latch to engage and release said latch when said boom is in said transport position and said fluid ram is moved from said fully extended position toward said retracted position.

2. An earthworking implement as defined in claim 1, in which said extension is pivoted on said first element and further includes retaining means for releasably retaining said extension in a fixed position on said first element.

3. An earthworking implement as defined in claim 2, in which said retaining means includes a removable pin with said first element and said extention having openings alignable with each other to receive said removable pin.

4. An earthworking implement as defined in claim 1, in which said swing tower has a pair of spaced lugs extending therefrom and said latch includes a base portion having a pair of arms with a pivotal connection between each lug and arm and in which said arms extend along opposed surfaces of said boom and said pin means includes a pair of pins respectively secured to said exposed surfaces.

* * * * *